United States Patent [19]

Thompson, Jr. et al.

[11] Patent Number: 4,989,530

[45] Date of Patent: Feb. 5, 1991

[54] LOW DRAG HOMING TORPEDO NOSE ASSEMBLY HAVING SIDE MOUNTED PLANAR ARRAYS

[75] Inventors: William Thompson, Jr., State College; W. Jack Hughes, Boalsburg; Robert D. Marciniak; Daniel L. DiGiannantoni, both of State College, all of Pa.

[73] Assignee: The United States of America as represented by the Secretary of the Navy, Washington, D.C.

[21] Appl. No.: 237,549

[22] Filed: Feb. 19, 1981

[51] Int. Cl.[5] ..... F42B 19/01

[52] U.S. Cl. ..... 114/21.3; 367/153

[58] Field of Search ..... 367/153, 155, 88; 114/21 A, 22, 21 R

[56] References Cited

U.S. PATENT DOCUMENTS

| | | | |
|---|---|---|---|
| 2,409,632 | 10/1946 | King | 114/21.3 |
| 2,865,016 | 12/1958 | Hudimac et al. | 367/153 |
| 3,145,679 | 8/1964 | Brooks | 367/153 X |
| 3,441,904 | 4/1969 | Wilson | 367/153 |
| 3,492,634 | 1/1970 | Massa | 367/153 |
| 3,663,934 | 5/1972 | Whitehouse et al. | 367/153 |
| 3,905,009 | 9/1975 | Hughes et al. | 367/123 X |
| 4,158,189 | 6/1979 | Wardle | 367/153 |
| 4,192,246 | 3/1980 | Hodges et al. | 367/155 X |
| 4,262,344 | 4/1981 | Gilmour | 367/88 |

*Primary Examiner*—David H. Brown

*Attorney, Agent, or Firm*—Michael J. McGowan; Prithvi C. Lall

[57] ABSTRACT

A low drag nose assembly for use with an acoustic homing torpedo in an aqueous environment has at least one planar array mounted in the slanting side of a substantially conical support member and provides a plurality of preformed sonar beams which display an azimuth selectively extending from fore to aft simultaneously.

7 Claims, 4 Drawing Sheets

LOW DRAG HOMING TORPEDO NOSE ASSEMBLY HAVING SIDE MOUNTED PLANAR ARRAYS

BACKGROUND OF THE INVENTION

This invention is drawn to the field of underwater acoustics, and more particularly, to a low drag homing torpedo nose assembly having side mounted planar arrays, which, with suitable associated electronics, are capable of forming a plurality of preformed beams displaying an azimuth which selectively extends from vehicle fore to vehicle aft.

Conventional homing torpedos use an acoustic sensor of the so-called forward looking variety which typically comprises a planar array of transducer elements mounted in a blunt shaped nose section of the vehicle in such a manner that the beams formed by the array selectively display an azimuth centered to vehicle fore. U.S. Pat. No. 4,192,246, issued Mar. 11, 1980 to Hodges et al, incorporated herein by reference, is exemplary of the forward looking acoustic homing torpedo.

In order to search those regions of an aqueous medium which lie outside the azimuth of the forward looking array, the torpedo executes a preprogrammed snake-like path which points the nose assembly to port and to starboard repetitively. The torpedo switches to an attack mode after target detection and adopts a course calculated to intercept the target. Whenever the target vehicle is moving, the intercept course closes the torpedo on a nonperpendicular angle of attack. In such a situation, it often happens that the forward looking sensor loses track of the target vehicle and the torpedo must again switch back to the search mode.

Thus, the extensive vehicle maneuvering, which is often required by this search and close procedure, when combined with significant hydrodynamic drag resulting from, among other factors, the blunt shaped nose assembly, effectively limits maximum range for a given quantity of fuel. Conversely, for a given range, it places a minimum limit on the quantity of the fuel required, which is often fifty (50) to sixty (60) percent of vehicle volume, thereby detracting from the payload volume.

SUMMARY OF THE INVENTION

The novel homing torpedo nose assembly of the present invention overcomes the deficiencies of the prior art by providing a low drag, hydrodynamically shaped nose assembly having a pair of side mounted planar arrays each of which displays an azimuth that selectively extends from vehicle fore to vehicle aft simultaneously without requiring extensive vehicle maneuvering. In this manner, the novel low drag homing torpedo nose assembly of the present invention searches a wide azimuth with minimal fuel expenditure and is less subject to lose a target in the attack mode.

The low drag homing torpedo nose assembly of the present invention includes a substantially conical pressure bulkhead having port and starboard apertures and a pair of planar arrays of transducer elements mounted in these apertures for providing a plurality of preformed port and starboard beams displaying an azimuth that selectively extends from vehicle fore to vehicle aft on both sides without the need for extensive vehicle maneuvering.

According to one feature of the preferred embodiment, each planar array utilizes a plurality of plug-in tonpilz type transducer elements arranged into a diamond shaped matrix having five (5) rows and ten (10) columns. The diamond shaped array matrix is mounted to an array housing having an octagonally shaped outside perimeter. This assembly is mounted to a matching octagonally shaped aperture provided in the substantially conical pressure bulkhead such that the plane of each array lies at an acute angle to the longitudinal axis of the vehicle.

According to another feature of the preferred embodiment, the arrays are so energized as to form seven (7) port and seven (7) starboard beams simultaneously. The port and starboard beams "look" forward as well as "over the shoulder" of the vehicle at an acceptable self-noise level over the range of operating depths and speeds.

According to another feature of the preferred embodiment, an acoustically transparent waterproofing window of polyurethane is disposed over the individual radiating faces of the transducers used to form the planar arrays. A hydrodynamically shaped low drag fairing that stabilizes laminar flow is disposed over the substantially conical pressure bulkhead and completes the homing torpedo nose assembly. A pressure compensated acoustical coupling fluid completely fills the space between the fairing and the pressure bulkhead.

Accordingly, it is an object of the present invention to provide a low drag homing torpedo nose assembly providing a plurality of preformed beams that display an azimuth that selectively extends from vehicle fore to vehicle aft without requiring extensive vehicle maneuvering.

A related object is to provide such a nose assembly that displays such an azimuth to port and to starboard simultaneously.

Yet another related object is to provide such a nose assembly displaying such an azimuth at an acceptable self-noise level over the range of operating depths and speeds.

Other objects, advantages and novel features of the present invention will become apparent by reference to the appended claims, the following detailed description and the drawings, wherein like parts are similarly designated throughout, and wherein:

DESCRIPTION OF THE PREFERRED EMBODIMENT

Figure 1:
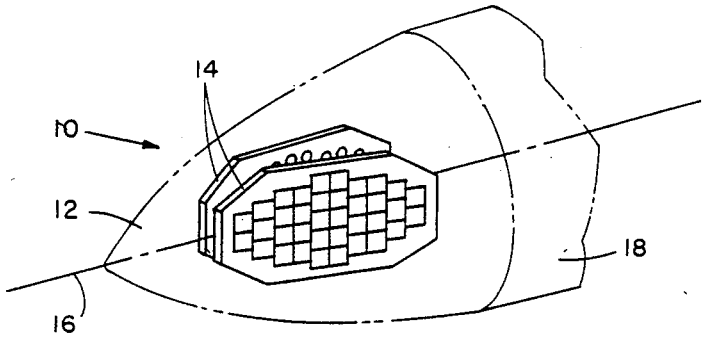
FIG. 1 is a stylized perspective view showing a low drag homing torpedo nose assembly according to the present invention.

Referring now to FIG. 1, generally designated at 10 is a stylized perspective view showing the homing torpedo nose assembly according to the present invention. Nose assembly 10 includes a low drag, substantially conical front end 12 and a pair of planar arrays 14 of transducer elements. The arrays 14 are positioned in the member 12 to provide an "A" shaped orientation about the longitudinal axis 16 of the assembly 10. Nose assembly 10 is mounted to a body 18 of an underwater homing torpedo. Body 18 includes such conventional systems as propulsion, inertial guidance, payload, command and control logic and the like, not shown.

Figure 2:
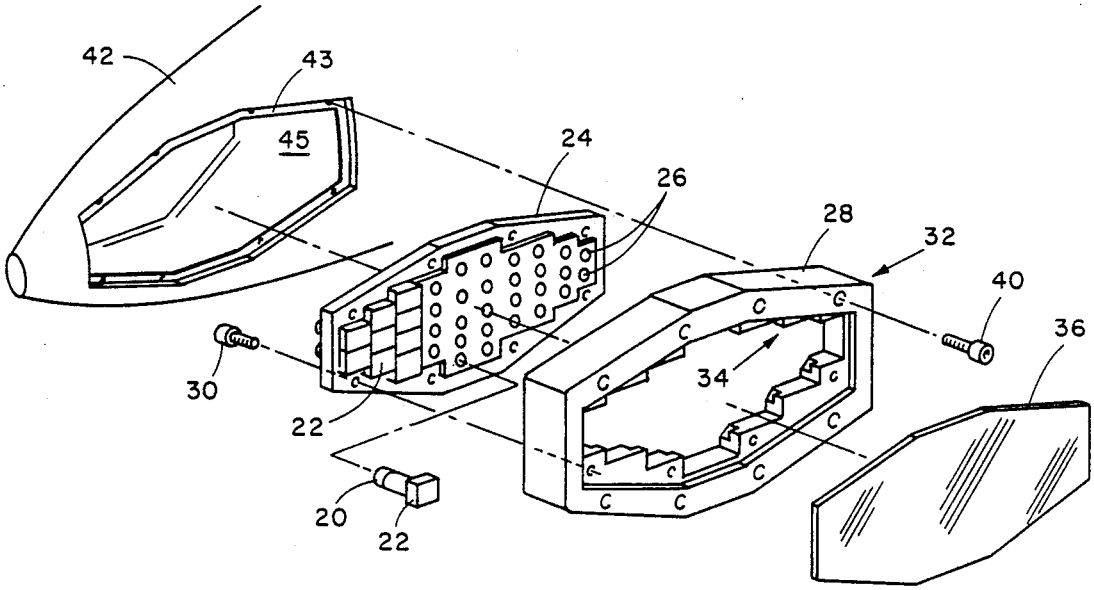
FIG. 2 is an exploded perspective view showing one array of the homing torpedo nose assembly according to the present invention.

Referring now to FIG. 2, which shows an exploded perspective side view of the assembly 10 according to the preferred embodiment, a plurality of tonpilz type transducer elements 20 having square radiating faces 22 are inserted into a planar structural support web member 24 having a plurality of apertures 26 arranged into a diamond shaped matrix having five (5) rows and ten (10) columns. Elements 20 suitably may have, inter alia, either a single stage support collar, for example, of a syntactic foam material, or a trilaminar support collar, for example, foam-mass insert-foam.

Web 24 is mounted to an array housing 28 as by bolts 30. Housing 28 has an octagonally shaped outside perimeter 32 and a diamond shaped inside perimeter 34 matching the above described diamond shaped (5)×(10) matrix of transducer elements formed by the web 24. An acoustic window 36 of any suitable material, such as polyurethane, is provided abutting the square radiating faces 22 of transducer elements 20.

Housing 28 is mounted, as by bolts 40, to an octagonally shaped receptacle member 43 welded or brazed in an aperture 45 formed in the slanting side of a substantially conical pressure bulkhead 42. An O-ring, not shown, is compressed between the inside face of the housing 28 and the outside face of the receptacle member 43 to provide a watertight seal. It should be noted that although the window 36 has been shown to be of constant thickness for clarity of presentation, housing 28 and window 36 are machined to conform to the shape of the pressure bulkhead 42 which results in windows which are of variable thickness.

Figure 3:
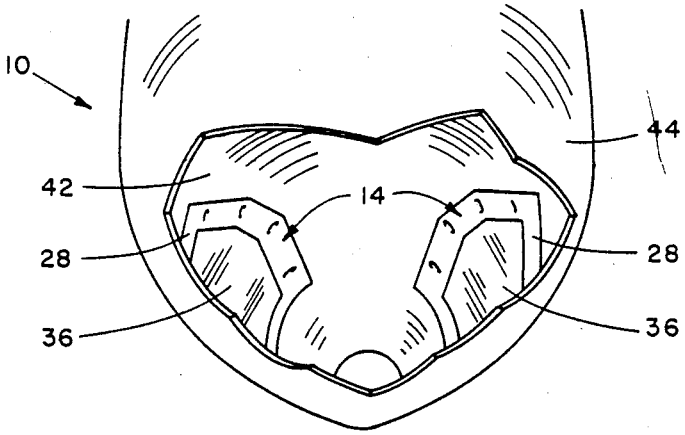
FIG. 3 is a view showing a front perspective of the homing torpedo nose assembly of the present invention with a hydrodynamic fairing partly broken away.

Referring now to FIG. 3, which is a view showing a front perspective of the assembly 10, the arrays 14 are mounted to port and to starboard of the axis 16 in the apertures 45 provided in the slanting sides of the substantially conical pressure bulkhead 42. A substantially conical hydrodynamic fairing 44, shown partly broken away, is disposed over the bulkhead 42 and has an external surface contoured to provide low drag laminar flow in a manner well known to those skilled in the art. Fairing 44 may suitably be made acoustically transparent by fashioning it, for example, from thin aluminum.

Figure 4:
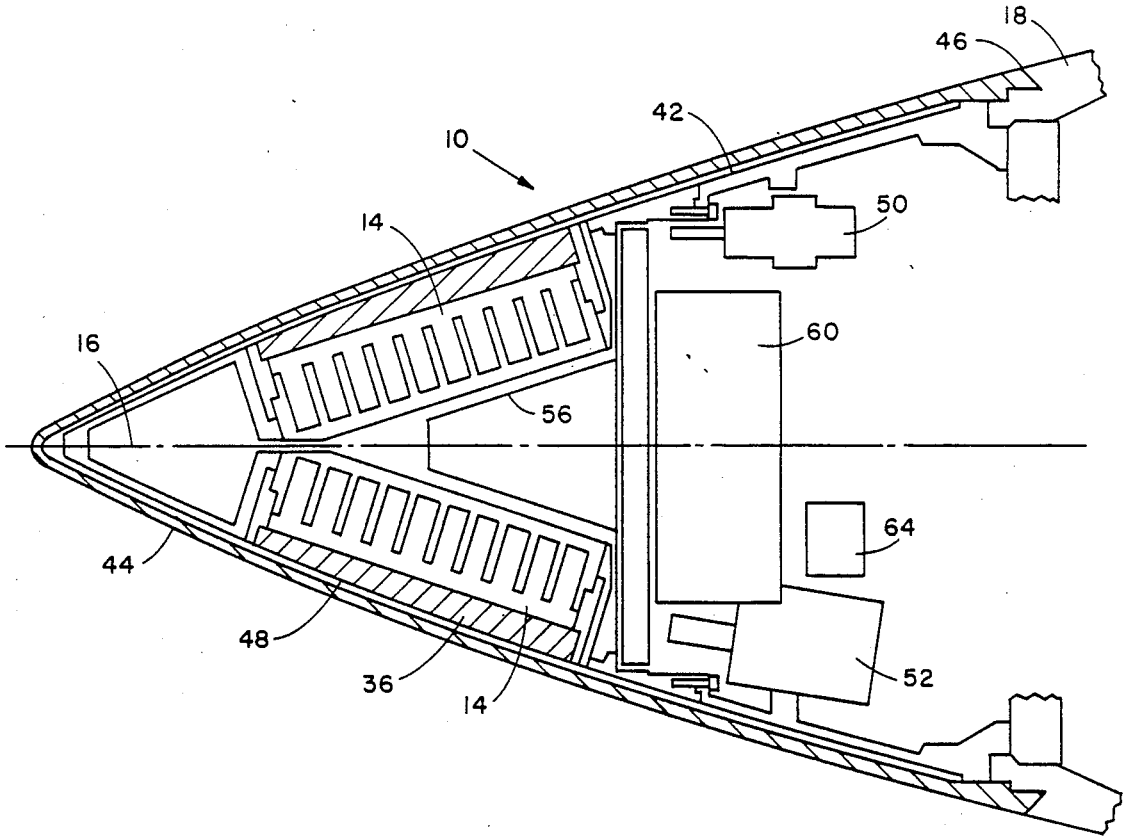
FIG. 4 is a sectional view of the homing torpedo nose assembly of the present invention.

Referring now to FIG. 4, which shows a sectional view of the assembly 10, the fairing 44 is matchmachined as at 46 to the body 18 and is joined thereto, for example, by a toothed locking mechanism, not shown. An acoustical coupling fluid 48, such as castor oil, is provided in a cavity formed between the bulkhead 42 and the fairing 44. In addition, any cavities at and around the locking mechanism at the joint 46 are fluid filled. A first expansion chamber 50 compensates for changes in the volume of fluid at the joint 46 and a second larger expansion chamber 52 compensates for ambient pressure induced changes in the volume of the fluid 48 in the cavity formed between the pressure bulkhead 42 and the fairing 44. For clarity of presentation, it is to be noted that the array 14 has been rotated by ninety (90) degrees in FIG. 4.

Figure 5:
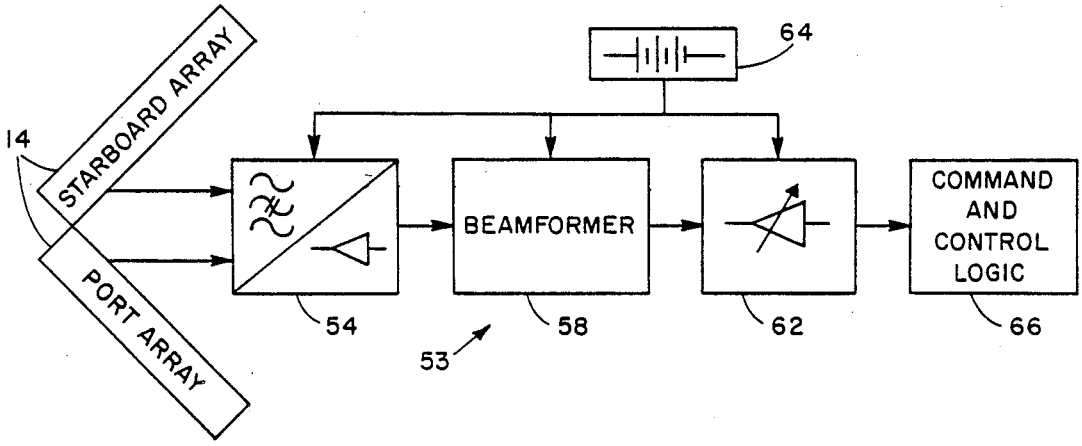
FIG. 5 is a schematic showing a block diagram of the electronic system of the homing torpedo nose assembly of the present invention.

Referring now to FIG. 5, which is a schematic showing a block diagram of the electronic system generally designated at 53 of the assembly 10, each of the arrays 14 is operatively connected to a bandpass filter/preamplifier means 54, a beamformer 58, a variable gain amplifying means 62 and command and control logic 66 in a manner well known to those skilled in the art. A battery 64 supplies power to the bandpass filter/preamplifier means 54, to the beamformer 58 and to the amplifying means 62. It is to be noted that although any suitable phase shift or time delay beamformer may be utilized, the single ninety (90) degree phase shift network shown and described in U.S. Pat. No. 3,905,009, issued Sept. 9, 1975 to Hughes et al, incorporated herein by reference, is preferred because of the comparative simplicity of the electronics therein shown and described.

As can be seen by referring to FIGS. 4 and 5, the filter and preamplifier means 54 may be mounted on a wedge-shaped hydrophone panel 56 and the beamformer 58 and amplifying means 62 may be mounted on a nose electronics tray 60 for optimal utilization of available space. It should be noted that the wedge-shaped hydrophone panel 56 also serves an an impedance buffer between the elements 20 of the arrays 14 and the input to the beamformer 58.

Figure 6:
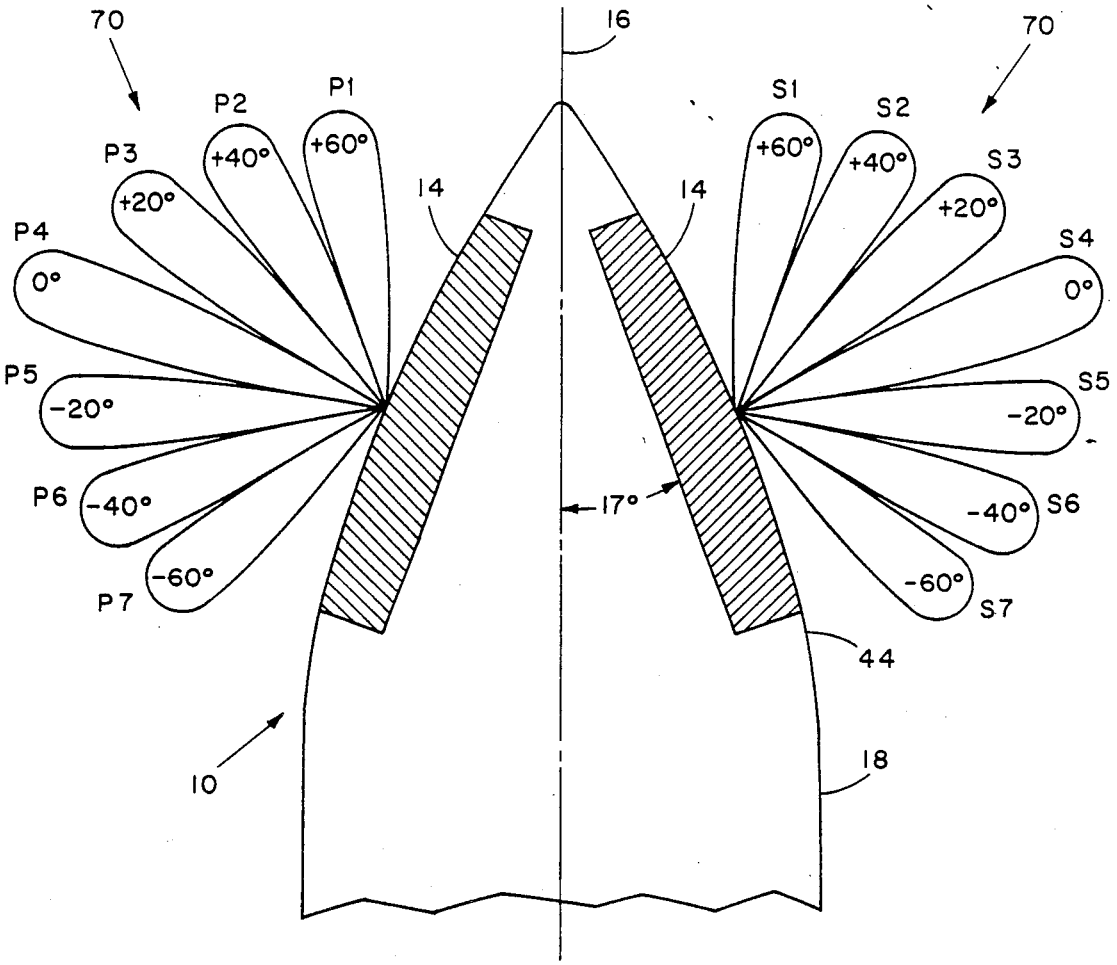
FIG. 6 is a stylized plan view showing the acoustical operation of the homing torpedo nose assembly of the present invention.
Figure 7:
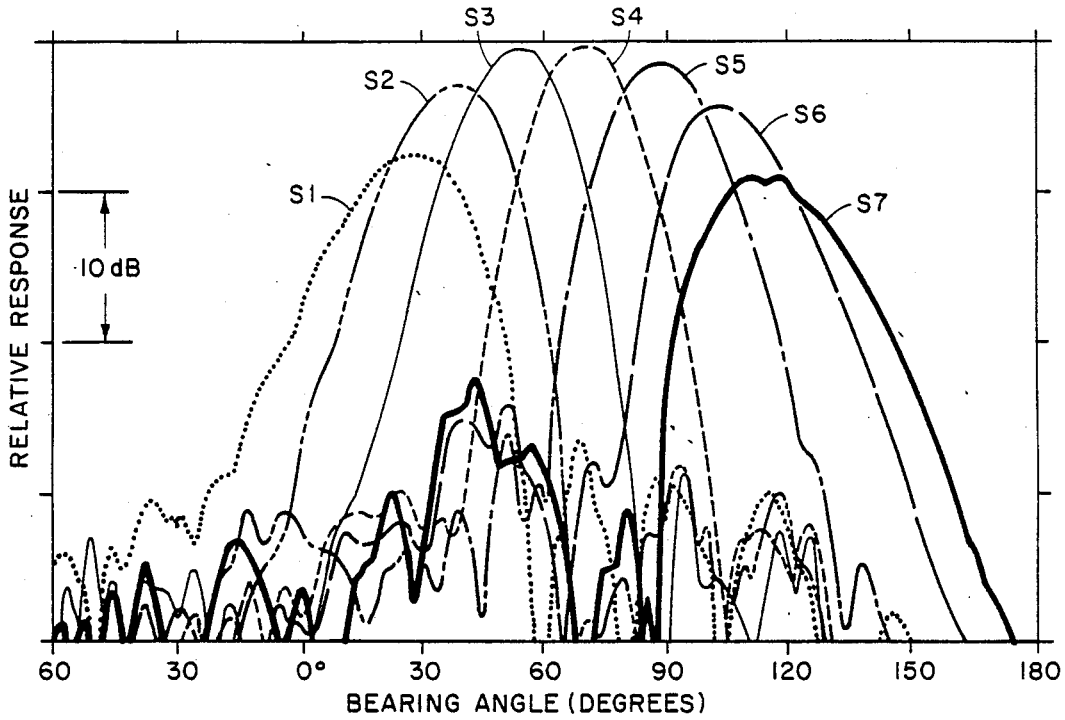
FIGS. 7 and 8 are graphs showing the directional response patterns of the starboard and port beams, respectively, with bearing angle.
Figure 8:
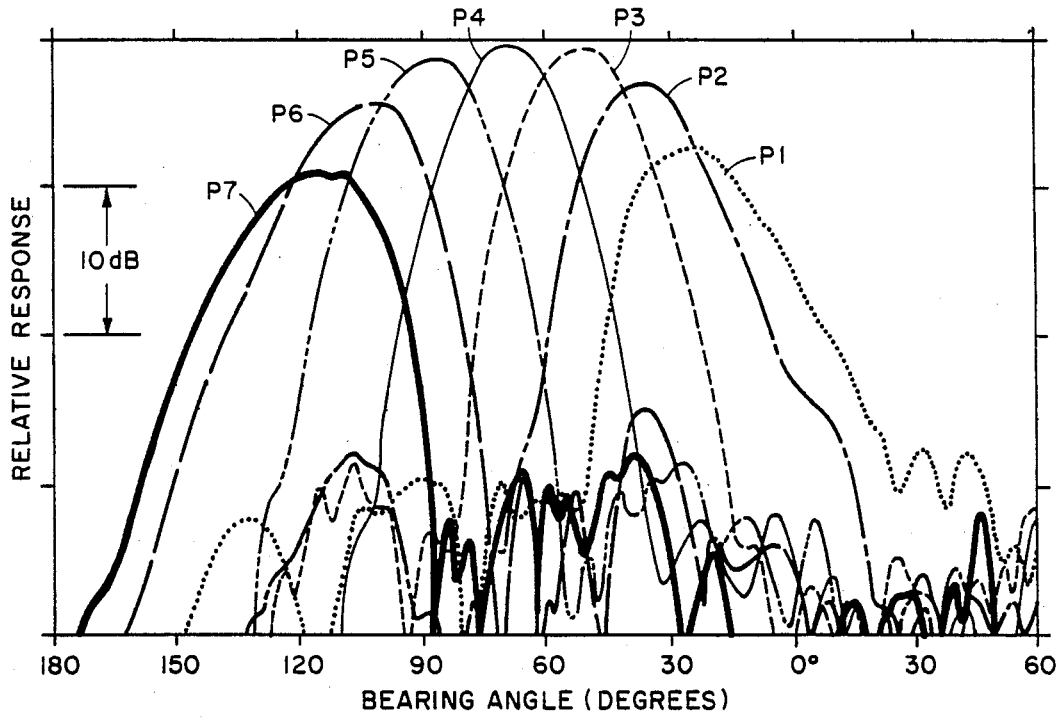

Referring now to FIG. 6, which is a stylized plan view showing the acoustical operation of the assembly 10, electronics 53 so energizes the arrays 14 as to provide a plurality of preformed sonar beams, generally designated at 70. As shown, seven (7) beams P1, P2 . . . P7 are provided to port and seven (7) beams S1, S2 . . . S7 are provided to starboard, each having a nominal twenty (20) degree angular beamwidth. Each of the arrays 14 is positioned at a seventeen (17) degree angle to the vehicle axis 16, and, as can be seen by referring to FIGS. 7 and 8 respectively, the corresponding port and starboard beams are well matched and display an azimuth selectively extending from approximately thirteen (13) degrees to fore to approximately one hundred and thirty-three (133) degrees to aft of the axis 16. It has been found that the novel nose assembly 10 of the present invention operates with an acceptable self-noise level over the range of operating speeds and depths with the beams tilted to fore comparatively quieter than those tilted to aft.

It is to be clearly understood that the parameters herein specified are exemplary rather than limitative, and that many variations of the presently disclosed nose assembly are possible. For example, the array 14 may have a wedge or trapezoidal shape; the transducer elements 20 may be of any suitable material or type and may have other than a square radiating face, and an ensemble of tilted beams may as well be formed in the active (or transmit) mode of operation as well as the passive (or receive) mode discussed hereinabove.

In summary, the novel low drag nose assembly of the present invention has a side mounted sonar which forms multiple preformed sonar beams displaying an azimuth that selectively extends from vehicle fore to vehicle aft without requiring extensive vehicle maneuvering.

We wish it to be clearly understood that we do not wish to be limited to the exact details of construction shown and described.

What is claimed is:

1. A low drag nose assembly suitable for use in an aqueous environment, comprising in combination:

a substantially conical pressure bulkhead having first and second apertures formed in the slanting side of said substantially conical pressure bulkhead said apertures being oriented at a preselected cone angle with respect to the pressure bulkhead longitudinal axis;

a first plurality of transducer elements having individual radiating faces;

a first web member having a plurality of holes adapted to receive said first plurality of transducer elements such that said individual radiating faces of said transducer elements are constrained to lie in a plane thus forming a first planar array;

a second plurality of transducer elements having individual radiating faces;

a second web member having a plurality of holes adapted to receive said second plurality of transducer elements such that said individual radiating faces of said transducer elements are constrained to lie in a plane thus forming a second planar array; and first and second means for mounting said first and second web members in said first and second apertures respectively, said apertures being provided in said slanting side of said substantially conical pressure bulkhead such that said first and second planar arrays are essentially side looking;

said first and second planar arrays each providing a plurality of preformed sonar beams which display an azimuth that selectively extends to fore, to side and to aft of said longitudinal axis simultaneously.

2. A low drag nose assembly as recited in claim 1, wherein said first and second plurality of transducer elements are of the tonpilz type and have square radiating faces.

3. A low drag nose assembly as recited in claim 2, wherein said holes of said first and second web members are arranged into a diamond shaped matrix having left-right and up-down symmetry.

4. A low drag nose assembly as recited in claim 3, wherein said first and second mounting means respectively comprise first and second web support housings adapted to receive said first and second web members, and first and second matching receptacle members, carried by said first and second apertures, adapted to receive said first and second web support housings.

5. A low drag nose assembly as recited in claim 4, further comprising first and second acoustic windows abutting said individual radiating faces of said first and second plurality of transducer elements.

6. A low drag nose assembly as recited in claim 5, further comprising a hydrodynamically shaped low drag fairing member disposed over said substantially conical pressure bulkhead and forming a cavity between said substantially conical pressure bulkhead and the inside surface of said fairing, and an acoustical coupling fluid disposed in said cavity.

7. A low drag nose assembly as recited in claim 6, wherein said first array is mounted to port of said longitudinal axis and said second array is mounted to starboard of said longitudinal axis.

* * * * *